US005425418A

United States Patent [19]

Arizmendi et al.

[11] Patent Number: 5,425,418

[45] Date of Patent: Jun. 20, 1995

[54] MULTIPLE-COMPLETION PACKER AND LOCKING ELEMENT THEREFOR

[75] Inventors: Napoleon Arizmendi; Jeffrey J. Lembcke, both of Houston, Tex.

[73] Assignee: Baker Hughes Incorporated

[21] Appl. No.: 233,807

[22] Filed: Apr. 26, 1994

[51] Int. Cl.[6] ..... E21B 23/00

[52] U.S. Cl. ..... 166/120; 166/134; 166/189

[58] Field of Search ..... 166/120, 134, 189, 387, 166/137

[56] References Cited

U.S. PATENT DOCUMENTS

| | | | |
|---|---|---|---|
| 3,252,516 | 5/1966 | Leutwyler | 166/189 X |
| 4,248,307 | 2/1981 | Silberman et al. | 166/189 X |
| 5,129,454 | 7/1992 | Telfer | 166/189 X |

*Primary Examiner*—William P. Neuder
*Attorney, Agent, or Firm*—Rosenblatt & Associates

[57] ABSTRACT

The invention relates to a multi-bore packer that has an annularly shaped sealing element. The assembly has a series of strings that run continuously so that they can be supported from the surface. At least one hub segment straddles the strings and is sealed in between. The entire assembly features one of the hubs with a sealing element. The outer sealing element, when compressed, seals against a casing or wellbore as well as against one of the hubs through which the strings extend. A greater effective piston area allows setting with surface pressures below 2500 psig. A provision is made in the assembly of hubs to provide for an operating mechanism to compress the outer seal between the casing and the hub, by increasing the applied sealing forces on the outer seal, should well conditions apply greater differential pressures, in either direction, to the outer seal than the original setting pressure used. A longitudinal lock is provided between a movable piston segment and one of the hubs to avoid actuation of the outer seal against the casing until a predetermined force is applied. During make-up, a secondary lock can be applied to the locking mechanism for pressure-testing purposes of the strings which run through the hubs. Finally, the lock mechanism features a design which retains a movable piston stationary after its actuation for release of the lock. Back-and-forth movement is prevented which may have a detrimental effect on the seals surrounding the movable piston in the lock assembly. Therefore, after the tool is set when the lock is unlocked, the piston component of the lock remains in a substantially fixed position, despite pressure fluctuations in the wellbore which would have otherwise urged the piston to move in opposed directions.

36 Claims, 16 Drawing Sheets

MULTIPLE-COMPLETION PACKER AND LOCKING ELEMENT THEREFOR

FIELD OF THE INVENTION

The field of the invention relates to sealing elements and actuation systems for downhole tools, particularly for multiple-completion packers and lock mechanisms for use downhole, particularly in multiple-completion packers.

BACKGROUND OF THE INVENTION

In the past, for a variety of reasons, well operators have needed to isolate different zones within the wellbore for production or stimulation reasons. To accomplish isolation of more than one zone within a wellbore, a multi-bore packer has generally been used, wherein two or more tubulars extend through the packer seal and the seal typically surrounds each of the tubulars within the packer housing. When such prior packers are actuated for pack-off against the casing, difficulties have been encountered in getting a complete and reliable seal around each of the tubulars. This is because the sealing element, disposed around each of the tubulars, was difficult to position appropriately so that it could be reliably squeezed radially outwardly for continuous contact with the casing to effect the necessary seal. The seal could be a single element that has bores therethrough so that the various strings can run through the element. However, setting this type of element by the traditional method of sliding sleeves has in the past created concerns about reliability of the seal around each of the strings. This was particularly true with regard to the space in between the strings in a situation where a sleeve compressed the sealing element to obtain the seal against the casing. Typical of such installations is U.S. Pat. No. 3,299,959. Other patents in the area of multiple-completion packers are U.S. Pat. Nos. 4,413,677; 3,224,508; 3,299,959; and 4,413,677.

Various locking mechanisms preventing longitudinal release have also been employed in the past. These typically involve the use of collets that are supported, followed by the removal of support for the collets by virtue of use of a shifting sleeve. Typical of such designs are U.S. Pat. Nos. 4,624,311; 4,516,634; 4,669,539; 5,180,010; and 5,217,077.

Also of general interest in the area of multi-string packer seals are U.S. Pat. Nos. 3,166,127; 3,211,226; 3,275,079; and 4,852,649.

The problems with prior lock assemblies is that they were mounted internal to the tool and fixed with frangible members such as shear pins. Accordingly, testing the connections as the packer assembly was run in the hole created a hazard that the various frangible members holding the lock mechanisms would shear, prematurely defeating the lock. Additionally, once a lock mechanism actuated, prior designs did not provide a design feature to immobilize the piston of the lock assembly to avoid cycling downhole upon pressure fluctuations experienced by the lock piston. The lock mechanisms of prior designs involved seals such as O-rings which, if retained by components that were subject to back-and-forth cycling upon pressure variations, could jeopardize the seal integrity of the string or strings running through a packer.

Accordingly, the apparatus of the present invention provides for a simple and reliable way to seal multi-string packers involving a unitary external seal, coupled with a plurality of internal seals which can tolerate relative movement. The apparatus is adaptable for two or more strings through a packer housing or hub. Additionally, a lock mechanism, accessible from outside the hub, is provided to facilitate pressure-testing by the rig crew during make-up and run-in into the wellbore. Once actuated to unlock, another feature is provided which retains the locking mechanism in a stationary position to avoid excessive wear on sealing components which could undermine the force exerted on the slips and sealing elements.

SUMMARY OF THE INVENTION

The invention relates to a multi-bore packer that has an annularly shaped sealing element. The assembly has a series of strings that run continuously so that they can be supported from the surface. At least one hub segment straddles the strings and is sealed in between. The entire assembly features one of the hubs with a sealing element. The outer sealing element, when compressed, seals against a casing or wellbore as well as against one of the hubs through which the strings extend. A greater effective piston area allows setting with surface pressures below 2500 psig. A provision is made in the assembly of hubs to provide for an operating mechanism to compress the outer seal between the casing and the hub, by increasing the applied sealing forces on the outer seal, should well conditions apply greater differential pressures, in either direction, to the outer seal than the original setting pressure used. A longitudinal lock is provided between a movable piston segment and one of the hubs to avoid actuation of the outer seal against the casing until a predetermined force is applied. During make-up, a secondary lock can be applied to the locking mechanism for pressure-testing purposes of the strings which run through the hubs. Finally, the lock mechanism features a design which retains a movable piston stationary after its actuation for release of the lock. Back-and-forth movement is prevented which may have a detrimental effect on the seals surrounding the movable piston in the lock assembly. Therefore, after the tool is set when the lock is unlocked, the piston component of the lock remains in a substantially fixed position, despite pressure fluctuations in the wellbore which would have otherwise urged the piston to move in opposed directions.

DETAILED DESCRIPTION OF THE PREFERRED EMBODIMENT

Figure 1:
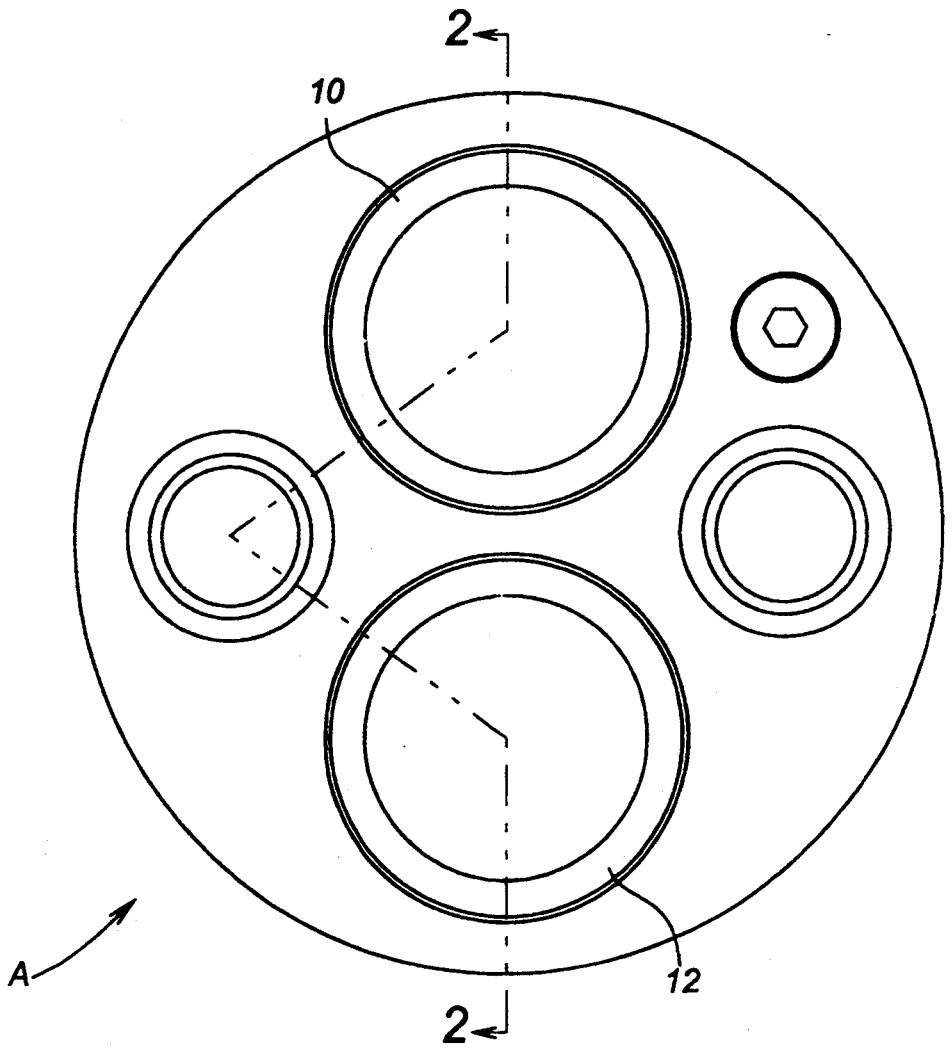
FIG. 1 is a top view of the apparatus of the present invention.
Figure 2A:
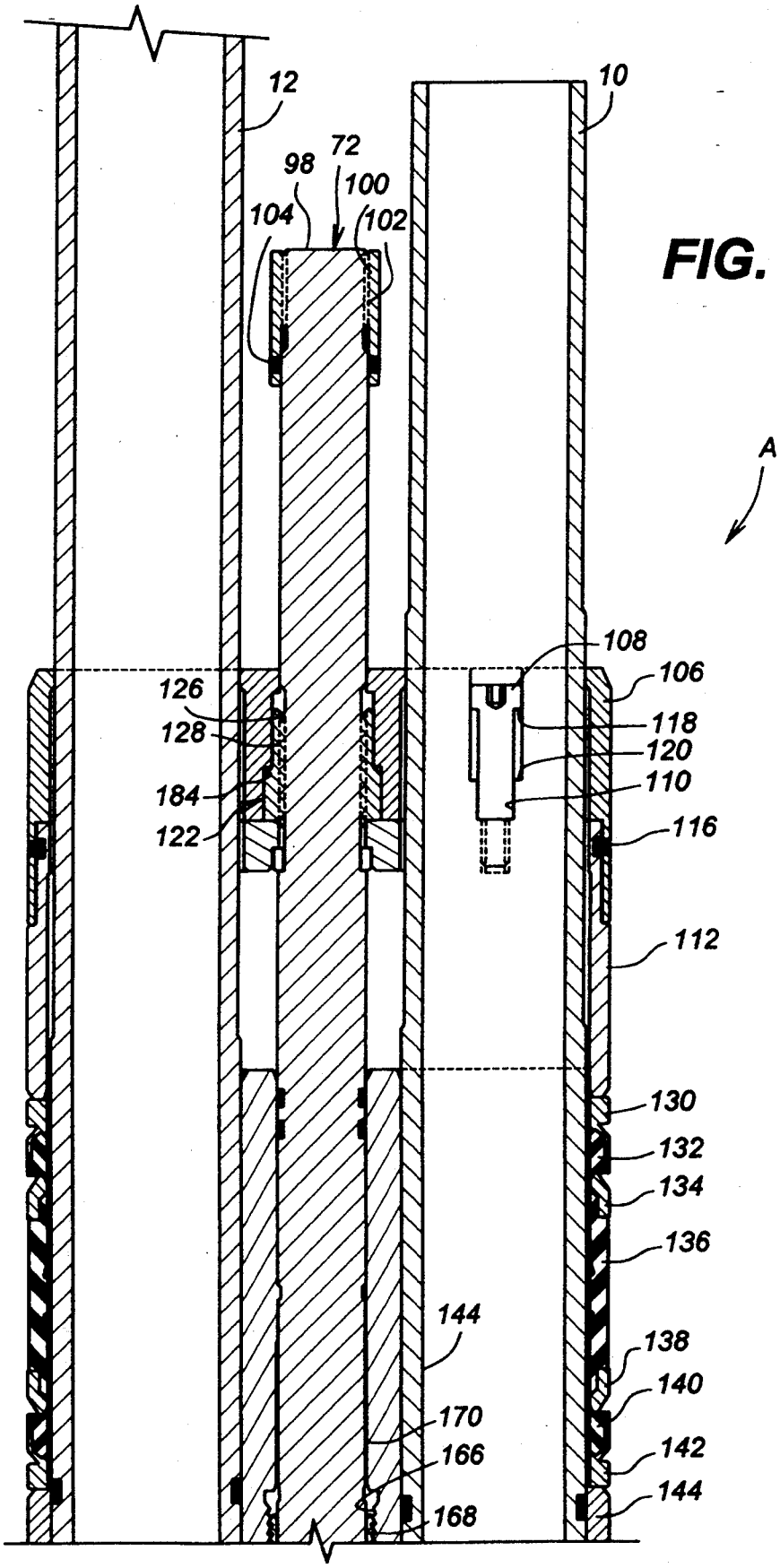
FIGS. 2*a*–2*c* are a segmented sectional view along lines 2—2 of FIG. 1, showing the apparatus in the run-in position.
Figure 2B:
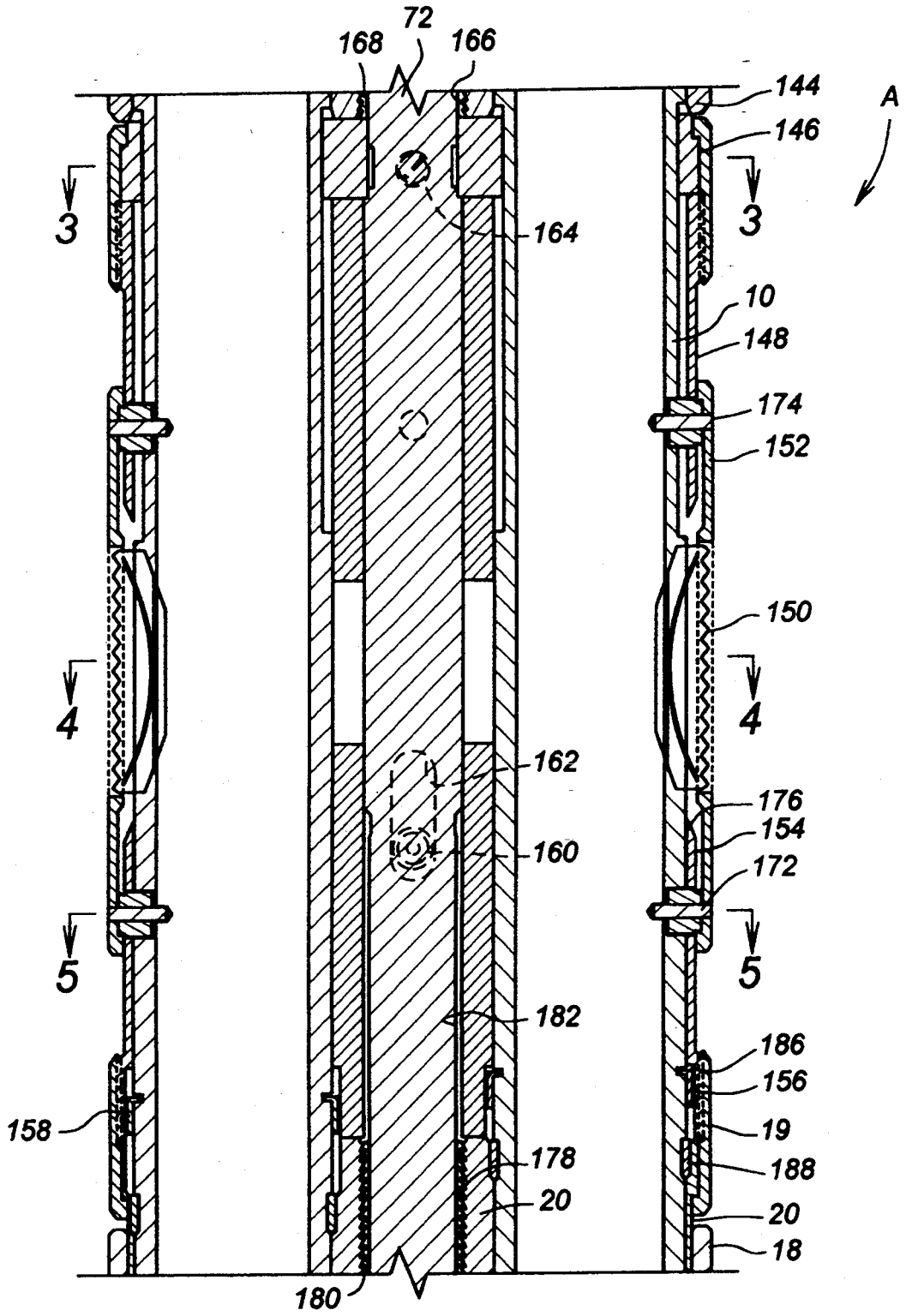
Figure 2C:
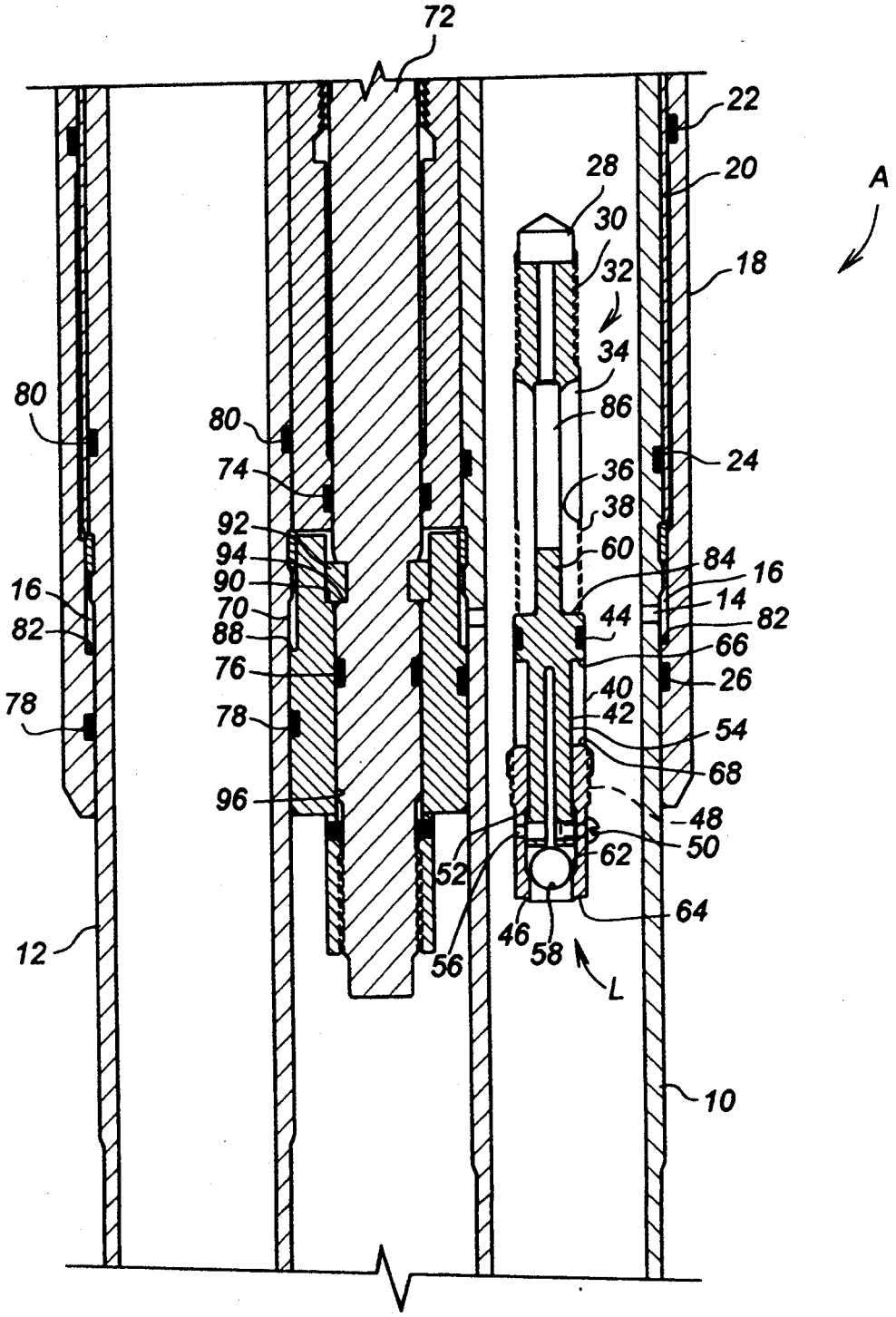
Figure 3:
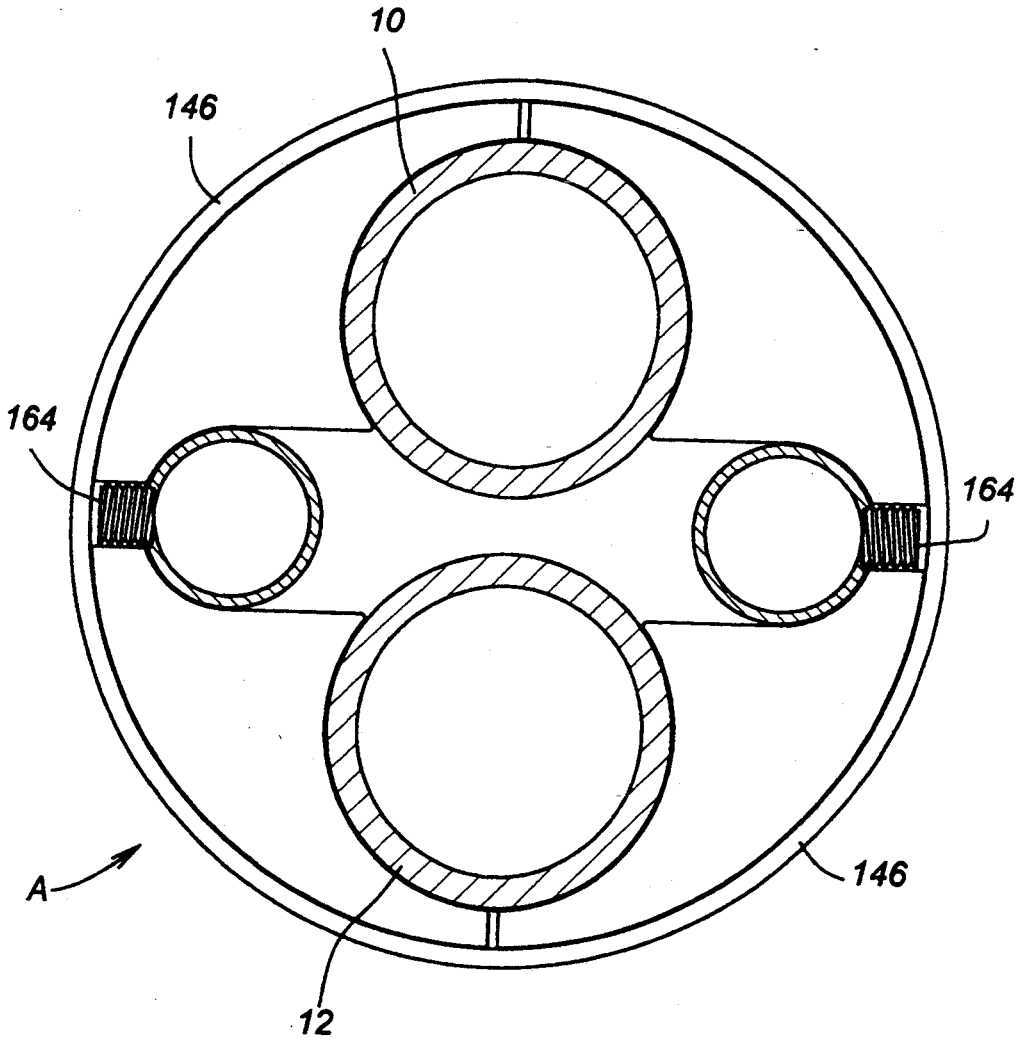
FIG. 3 is a sectional view along lines 3—3 of FIG. 2.
Figure 4:
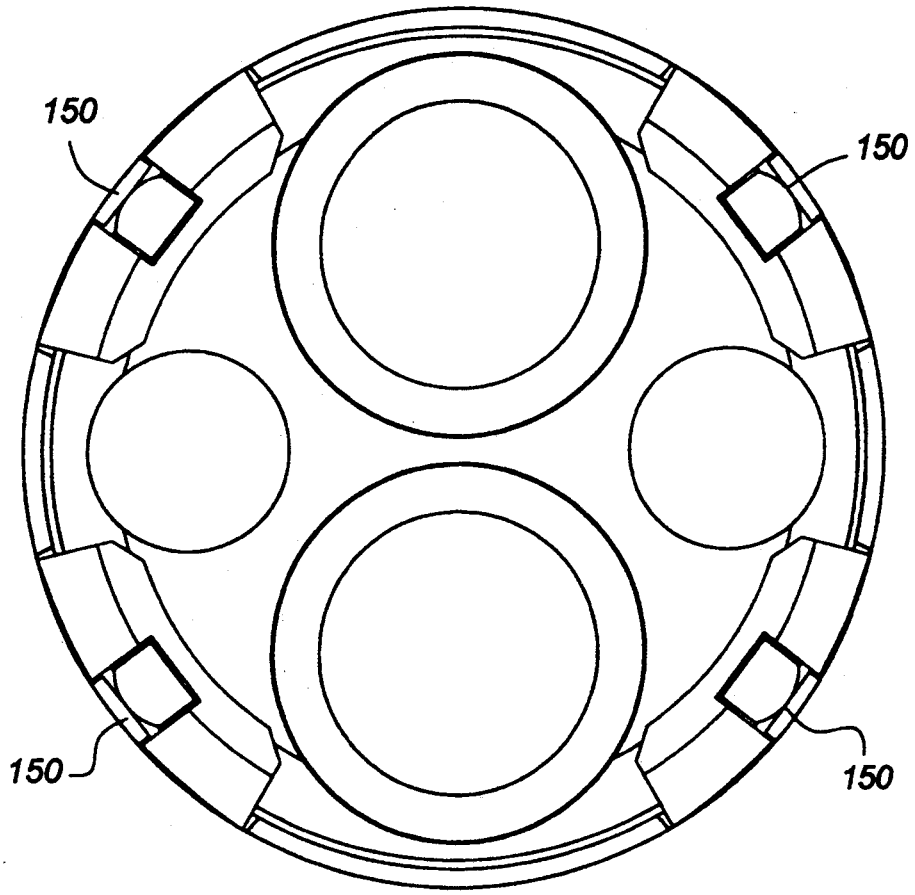
FIG. 4 is a sectional view along lines 4—4 of FIG. 2.
Figure 5:
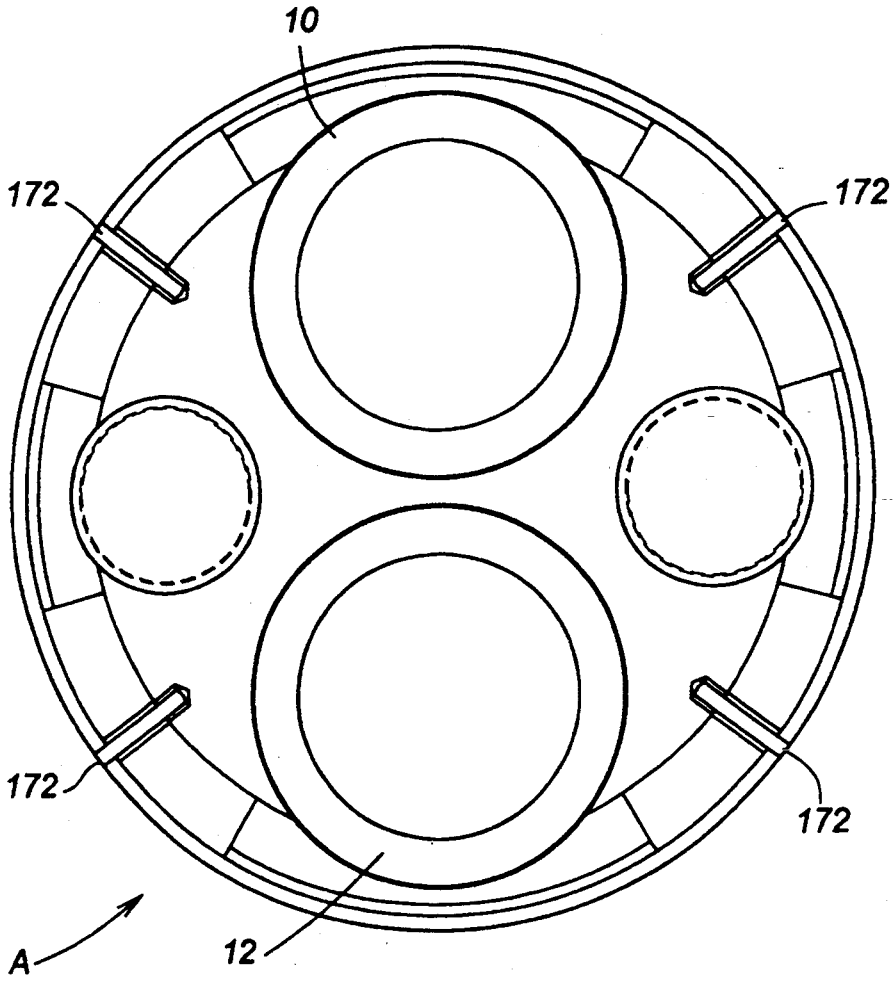
FIG. 5 is a sectional view along lines 5—5 of FIG. 2.
Figure 6:
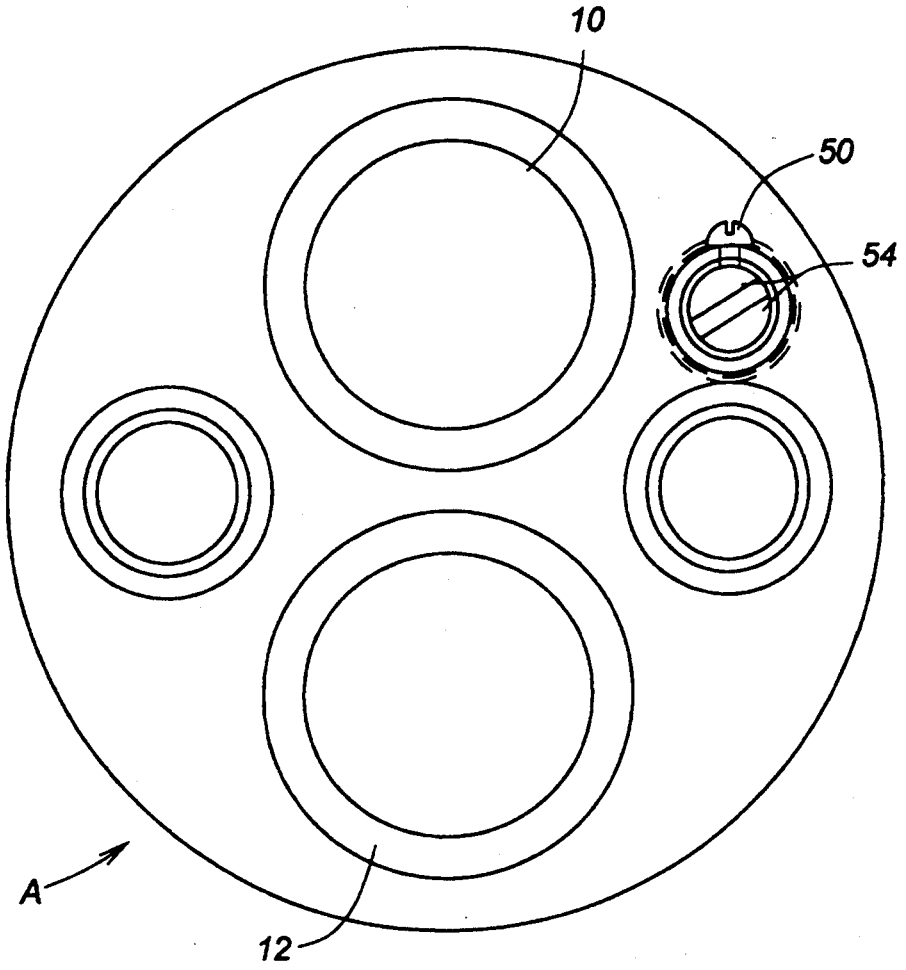
FIG. 6 is a bottom view of the apparatus of the present invention.

The apparatus A of the present invention is illustrated in detail in FIGS. 2a–2c. In the preferred embodiment, the apparatus A is a multi-bore packer which has a plurality of mandrels, such as 10 and 12. At least one of the mandrels has a lateral port 14, which communicates with a cavity 16 defined between the mandrel 10 and piston 18. A hub 20 extends into cavity 16 and is retained with respect to mandrels 10 and 12 by collar 19. Seal 22 seals between piston 18 and hub 20. Seal 24 seals between hub 20 and mandrel 10. Seal 26 seals between piston 18 and mandrel 10 such that application of pressure within mandrel 10 is transmitted through port 14 into cavity 16 so as to urge piston 18 downwardly away from hub 20.

A lock mechanism L is used to retain piston 18 to hub 20. Located within hub 20 is a cavity 28 that has a thread 30, which retains interlock collet 32. Interlock collet 32 is an assembly with longitudinally extending collet fingers 34, which have an outwardly facing thread 36, which in turn mates to thread 38 disposed in piston 18. Piston 18 further features a bore 40. Interlock-release piston 42 rides within bore 40 and is sealed thereto by seal 44. Piston retainer 46 is engaged to piston 18 at thread 48. Shear screw 50 extends through piston retainer 46 and into interlock-release piston 42 for selective retention thereof. The lower end of interlock-release piston 42 is formed having a reverse-oriented shoulder 52 disposed at the end of a flexible finger-like segment or segments 54. Segments 54 have a bore 56 through which extends pin 50. Piston retainer 46 also has a bore 58 transverse to its longitudinal axis. During run-in into the wellbore with the shear pin or pins 50 firmly in position, the piston 18 is not free to move with respect to the hub 20 because upper end 60 of interlock-release piston 42 supports thread 36 against thread 38, thereby allowing interlock collet assembly 34 to retain piston 18 to hub 20. However, upon application of sufficient pressure through mandrel 10 and into cavity 16 through port 14, a downward force is exerted on interlock-release piston 42, which breaks shear pin 50 and causes reverse- oriented shoulder 52 to flex inwardly and pass taper 62. Once the interlock- release piston 42 moves downward sufficiently, finger segments 54 spring radially outwardly to catch on mating taper 64. At that time, shoulder 66 bottoms on shoulder 68 of piston retainer 46. In that configuration, the interlock-release piston 42 is trapped with respect to piston retainer 46. At the same time, the upper end 60 having moved out from its position supporting the fingers 34, thread 36 is no longer engaged to thread 38, thereby allowing piston 18 to move downwardly with respect to hub 20.

The purpose of lateral bore 58 is to facilitate testing of mandrels 10 and 12 during the assembly at the surface. In order to conduct the leak test of the various seals within the apparatus A, as will be described below, a suitable rod of sufficient rigidity is inserted through bore 58. Internal pressure is then applied through mandrel 10. However, the shear pins 50 cannot break because the fingers 54 are adequately supported by the rod (not shown) which is selectively extended into bore 58. One of the distinct advantages of the present invention is to put the longitudinal lock mechanism L in an accessible position from the rig floor to facilitate the pressure-testing of the tubing string or strings which include mandrels 10 and 12 during make-up. Another advantage of the lock mechanism L as illustrated in FIG. 2c is that upon actuation, the interlock-release piston 42 is held relatively stationary with respect to piston retainer 46 or in a position where very little relative movement can take place. By reducing the relative movement, the seal life of O-ring seal 44 is dramatically improved. Fluctuations in downhole pressure can force interlock-release piston 42 to cycle if it were not otherwise retained to piston retainer 46 after actuation, as previously described.

Ports 14 are also in fluid communication with annular cavity 70. Cavity 70 circumscribes tension bar 72 and is isolated to retain the applied pressure through ports 14 by virtue of O-ring seals 74, 76, 78, and 80. Seal 74 seals between hub 20 and tension bar 72. Seal 76 seals between tension bar 72 and piston 18. Seal 78 seals between mandrel 12 and piston 18, while seal 80 seals between mandrel 12 and hub 20. As a result of applied pressure through ports 14, the area on piston 18 that pressure is exerted from ports 14 includes surfaces 82, 84, 86, 88, and 90. Tension bar lower split ring 92 links tension bar 72 to piston 18 such that pressure build-up in cavity 70 transmits a force to surface 94 on tension bar 72.

As shown in FIGS. 2a–2c, tension bar 72 extends through bore 96 of piston 18. Tension bar 72 extends to its upper end 98 as shown in FIG. 2A. At upper end 98, a tension bar retainer 100 is secured to tension bar 72 by thread 102 and set screw 104. Mandrels 10 and 12 extend through a lock nut retainer 106 (see FIG. 2a). Bolt 108 extends through bore 110 and secures lock nut retainer 106 to upper gauge ring 112. When it is desired to release the apparatus A, the shear pin 116 is broken and relative motion between upper gauge ring 112 and lock nut retainer 106 is possible until surface 118 on bolt 108 engages shoulder 120 within lock nut retainer 106. Further pulling retrieves the apparatus because the upward movement of gauge ring 112 allows seals 132, 136, and 140 to relax, as well as slips 150. This process is initiated by breaking shear rings 158 and 186 (see FIG. 2c).

Tension bar 72 is locked during run-in to lock nut retainer 106 by virtue of lock nut 122. Lock nut 122 has a lower end 124 which is thicker than the upper end 126. Lock nut 122 is secured to tension bar 72 by thread 128.

The seal assembly comprises a metal back-up ring 130. Upper gauge ring 112 bears on back-up ring 130, which in turn bears on end packing element 132, which bears on seal separator 134. Seal separator 134 bears on center packing element 136, which bears on seal separator 138, which in turn bears on lower end seal 140. Lower end seal 140 bears on back-up ring 142. The entire assembly of seals and rings 130–142 is supported by offset mandrel 144. Offset mandrel 144 bears on offset pick-up ring 146, which in turn bears on upper cone 148. A plurality of slips 150 are disposed adjacent to upper cone 148 and retained in a proper orientation by slip cage 152. Slips 150 bear on lower cone 154, which is fixed to mandrels 10 and 12 by shear rings 156 and 158, respectively. Lower cone 154 is kept from rotating with respect to tension bar 72 by virtue of cap screw 160 extending into groove 162.

Initially, offset pick-up ring 146 is fixed to tension bar 72 by virtue of shear pin or pins 164. Offset mandrel 144 has a series of teeth 166 which engage lock ring 168, which in turn engages teeth 170 on tension bar 72. Teeth 166 are oriented with respect to the teeth on lock ring 168 and the teeth 170 on tension bar 72 such that upward movement of offset mandrel 144 is locked in. This can occur after elements 132, 136, and 140 form a seal against the casing and the downhole pressure increases, exercising a net force on offset mandrel 144. The pack-off force on the sealing elements 132, 136, and 140 increases, and the additional pack-off force is locked in by virtue of the body lock ring 168.

A series of shear pins 172 initial retain mandrel 10 to lower cone 154 and slip cage 152. A second shear pin or pins 174 initially retain upper cone 148 and slip cage 152 to mandrel 10.

The significant portions of the apparatus now having been described, the operation of the apparatus will now be discussed in detail (see FIGS. 8*a*–8*d*). To actuate the apparatus A, pressure is applied from the surface within mandrel 10 through ports 14. When a sufficient force has developed to break shear pin 50, segments 54 move downwardly, thereby removing upper end 60 from supporting fingers 34. When this occurs, the engagement between piston 18 and hub 20 no longer exists at thread 38 because fingers 34 can flex radially inwardly. As a result, the force induced through pressure in cavities 16 and 70 transmits a pushing force onto tension bar 72, urging it downwardly. Since the mandrels 10 and 12 are retained in a stationary position, the downward force exerted on tension bar 72 at first shears pins 172. When this occurs, the lower end of the slips 150 is urged outwardly along the ramped surface 176 of lower cone 154. Shear pins 174 break next, allowing upper cone 148 to move downwardly against slips 150. Shear pins 164 then break after shear pins 174, which then permits the upper gauge ring 112 to move the entire seal assembly of parts 130–144 downwardly against offset pick-up ring 146. Ultimately, the slips 150 wedge against the casing (not shown), which stops any further movement of upper cone 148 and offset pick-up ring 146. With the continuing downward force being applied to tension bar 72, upper gauge ring 112 urges the sealing elements 132, 136, and 140 outwardly for sealing with the casing. At the same time, offset mandrel 144 is being pushed downwardly with the seals 132, 136, and 140, such that body lock ring 168 retains the position of tension bar 72 with respect to offset mandrel 144.

Hub 20 has a plurality of teeth 178 (see FIG. 2*c*) which engage lock ring 180, which in turn engages teeth 182 on tension bar 72. With the configuration as illustrated in FIG. 2C and 2D, tension bar 72 is free to move downwardly with lock ring 180 over teeth 178. However, the configuration of teeth 178 and 182, coupled with lock ring 180, prevent relative movement of tension bar 72 in an upward direction with respect to hub 20, thereby locking in the force on the seals 132, 136, and 140.

As a result, when the apparatus A is set, increased downhole forces will try to move tension bar 72 upwardly, but upward motion will be stopped by lock ring 180. However, that same increase in downhole pressure will act on offset mandrel 144, urging it upwardly to further increase the setting pressure on seals 132, 136, and 140. Any upward shifting of offset mandrel 144 is locked in by virtue of lock ring 168, which allows upward motion of offset mandrel 144 with respect to tension bar 72 but prevents motion in the opposite direction. On the other hand, if uphole pressures increase after the apparatus A is set, tension bar 72 is pushed downwardly, increasing sealing pressure on seals 132, 136, and 140 but is prevented from returning in an upward direction by virtue of lock ring 180.

Figure 9A:
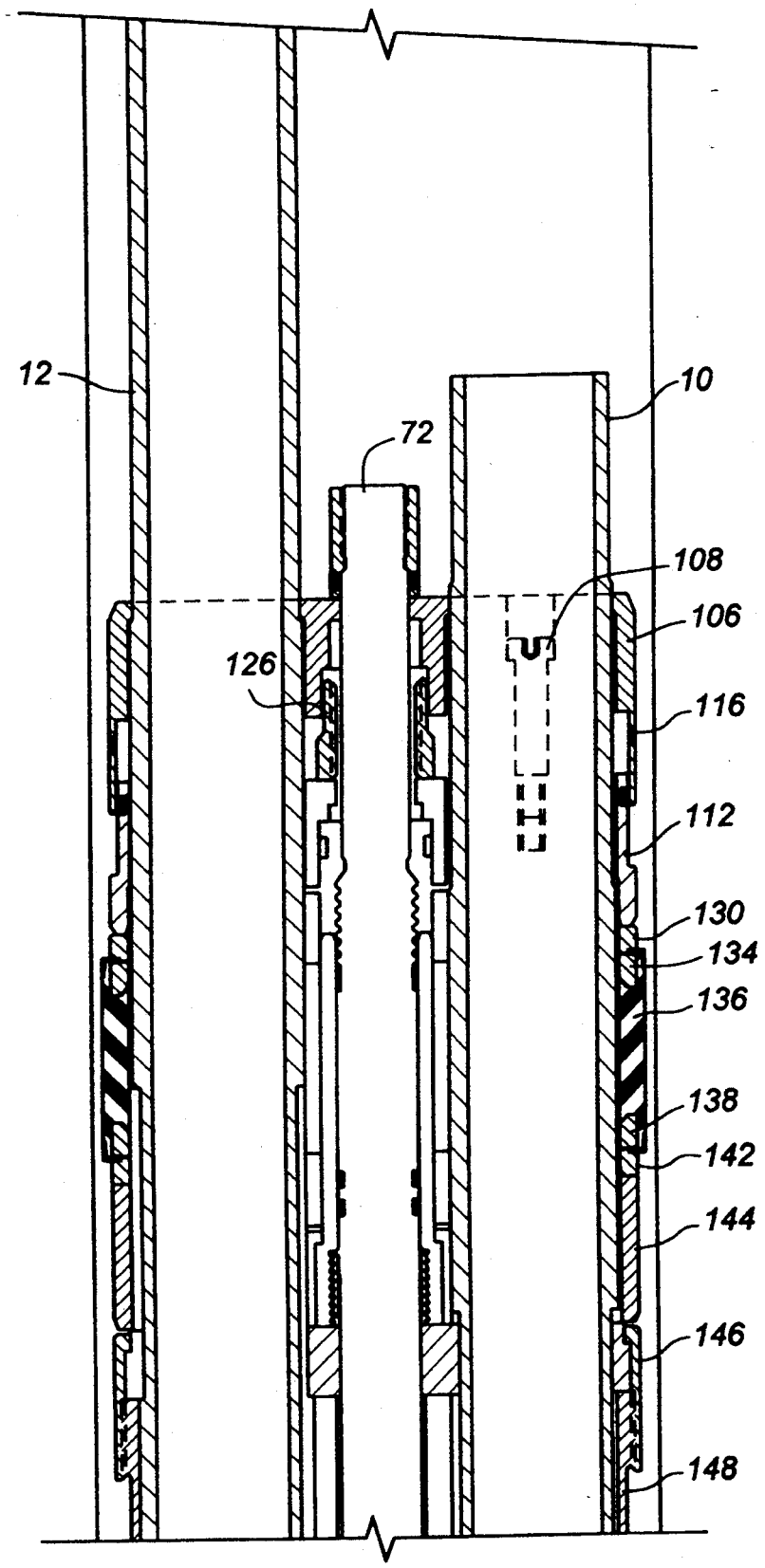
FIGS. 9*a*–9*c* are the view of FIGS. 8*a*–8*d*, with the tool in the released position.
Figure 9B:
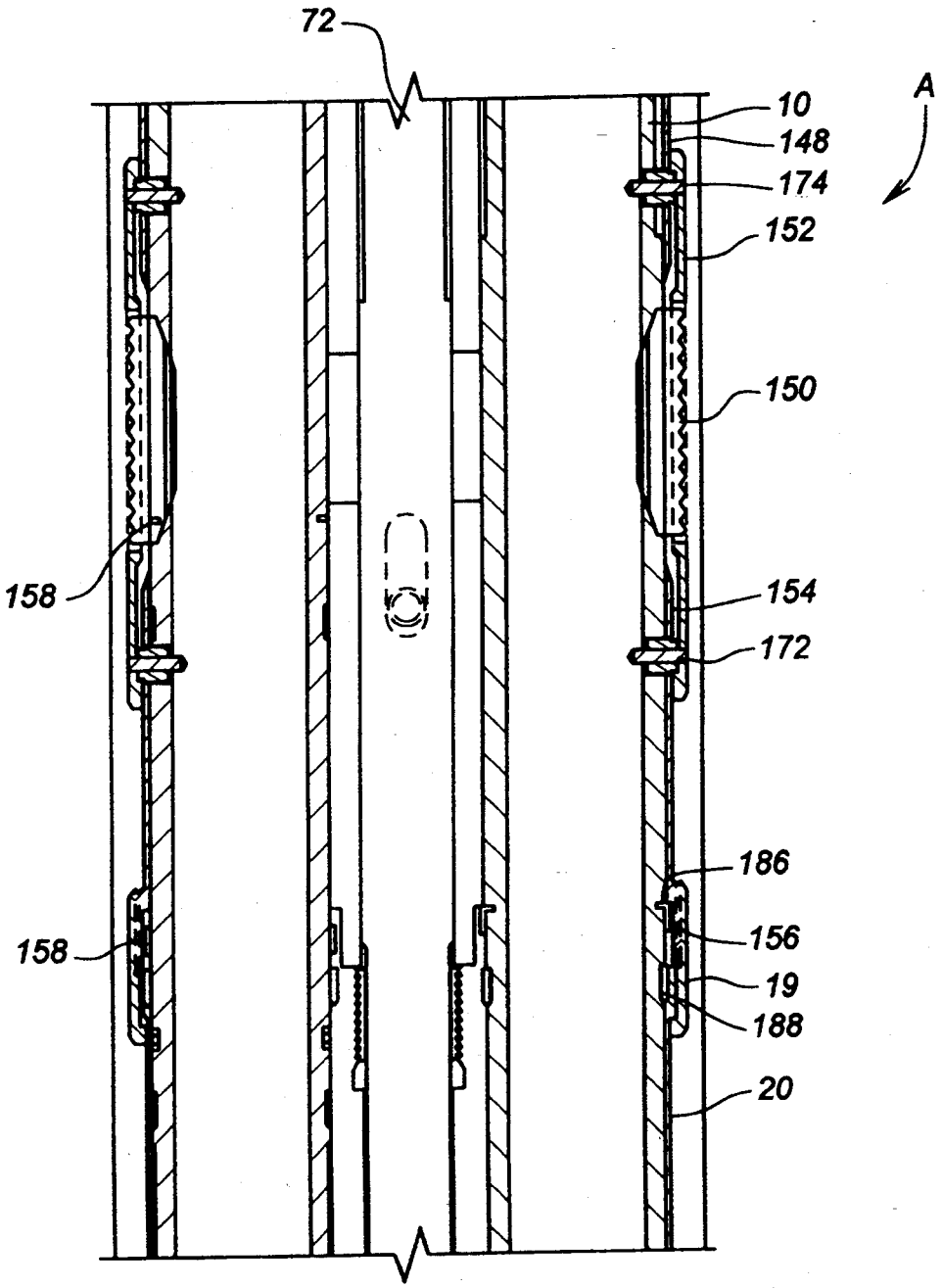
Figure 9C:
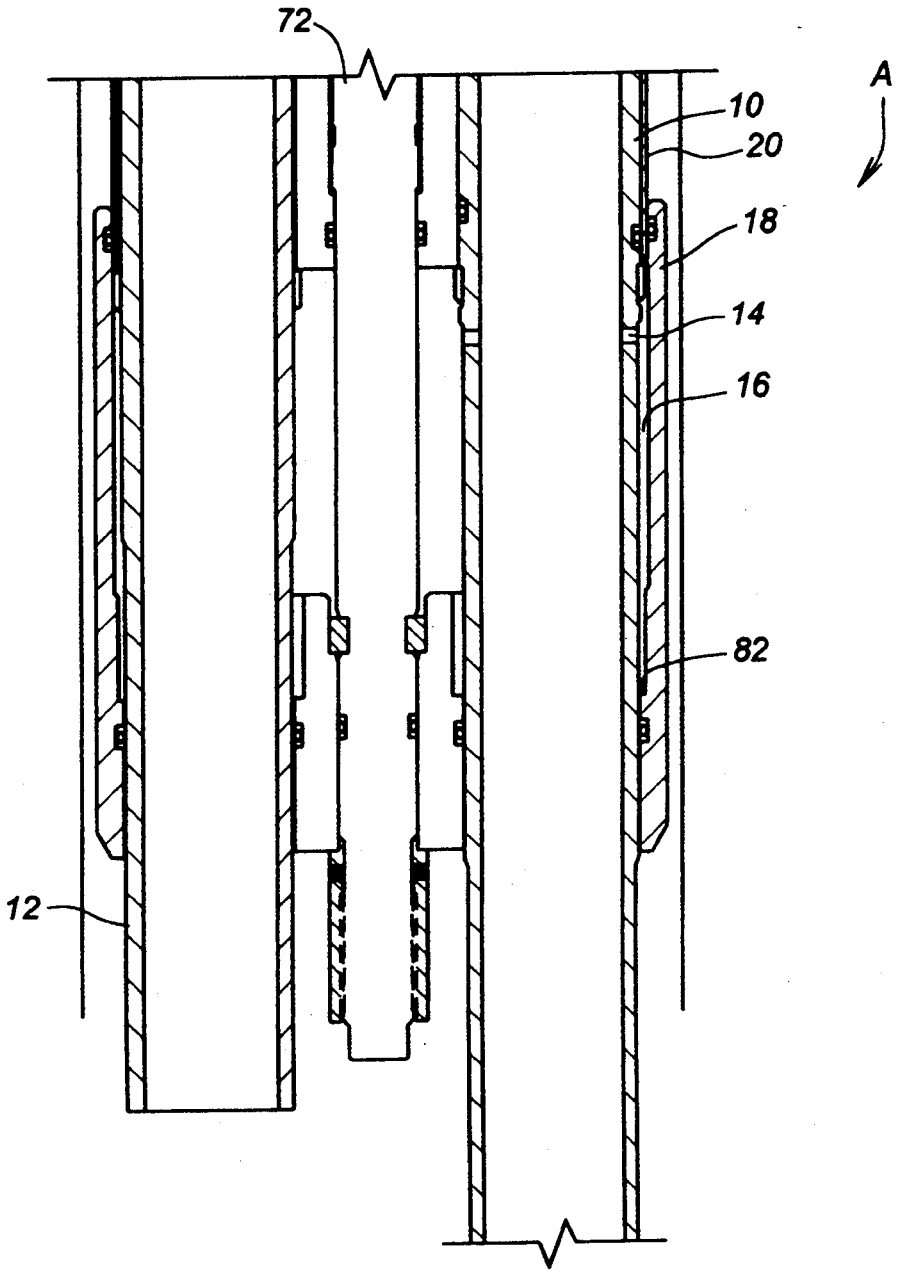

When it comes time to release the apparatus A of the present invention (see FIGS. 9*a*–9*c*), an upward force is applied to mandrel 10 and/or 12, shearing shear rings 158 and 186 and then shear pins 116. Thereafter, lock nut retainer 106 can move up with respect to upper gauge ring 112 until shoulder 120 hits surface 118. Upward movement of lock nut retainer 106 frees up the connection at thread 128 between tension bar 72 and lock nut 122. This occurs because of the upward shifting of lock nut retainer 106, which in turn positions surface 184 opposite the thin portion or upper end 126 of lock nut 122. Once this locking feature is released, upper gauge ring 112 is free to move upwardly, thereby releasing the sealing pressure on seals 132, 136, and 140. Thereafter, further upward pulling on mandrel 10 will bring up the apparatus A by virtue of snap ring 188, supporting the entire assembly starting with lower cone 154.

Figure 7:
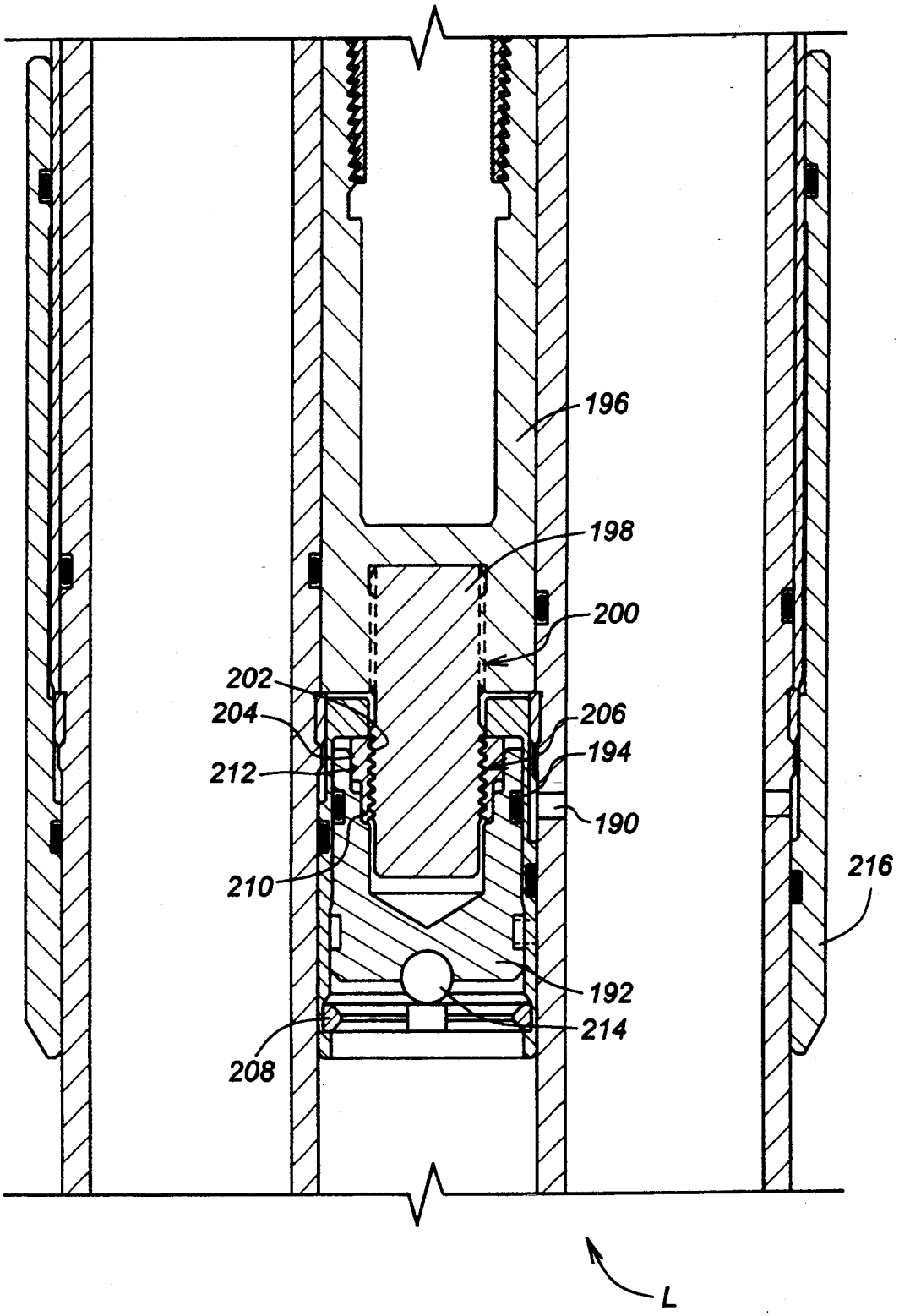
FIG. 7 is an alternative embodiment of the lock assembly.
Figure 8A:
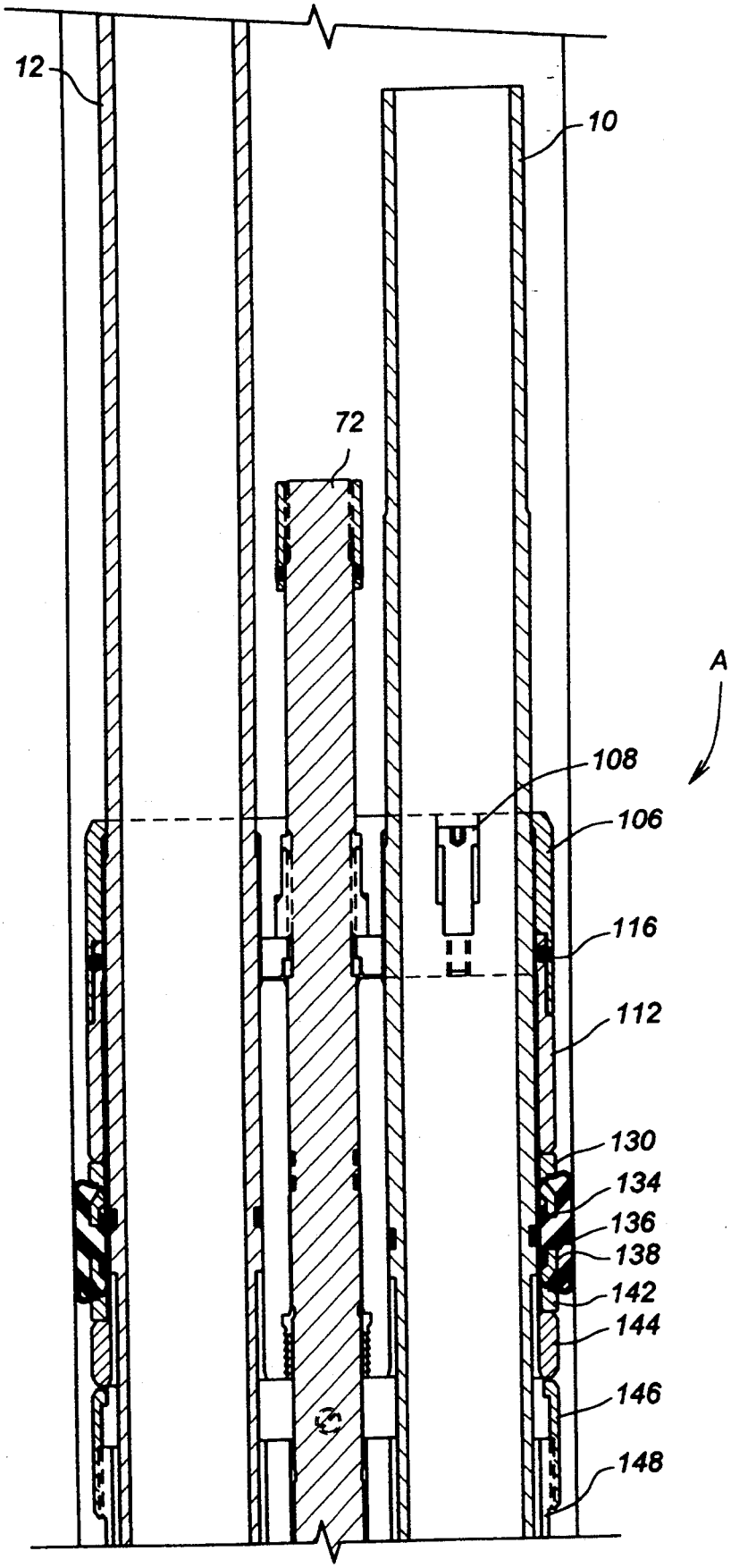
FIGS. 8*a*–8*c* are the view of FIGS. 2*a*–2*c* with the tool in the set position.
Figure 8B:
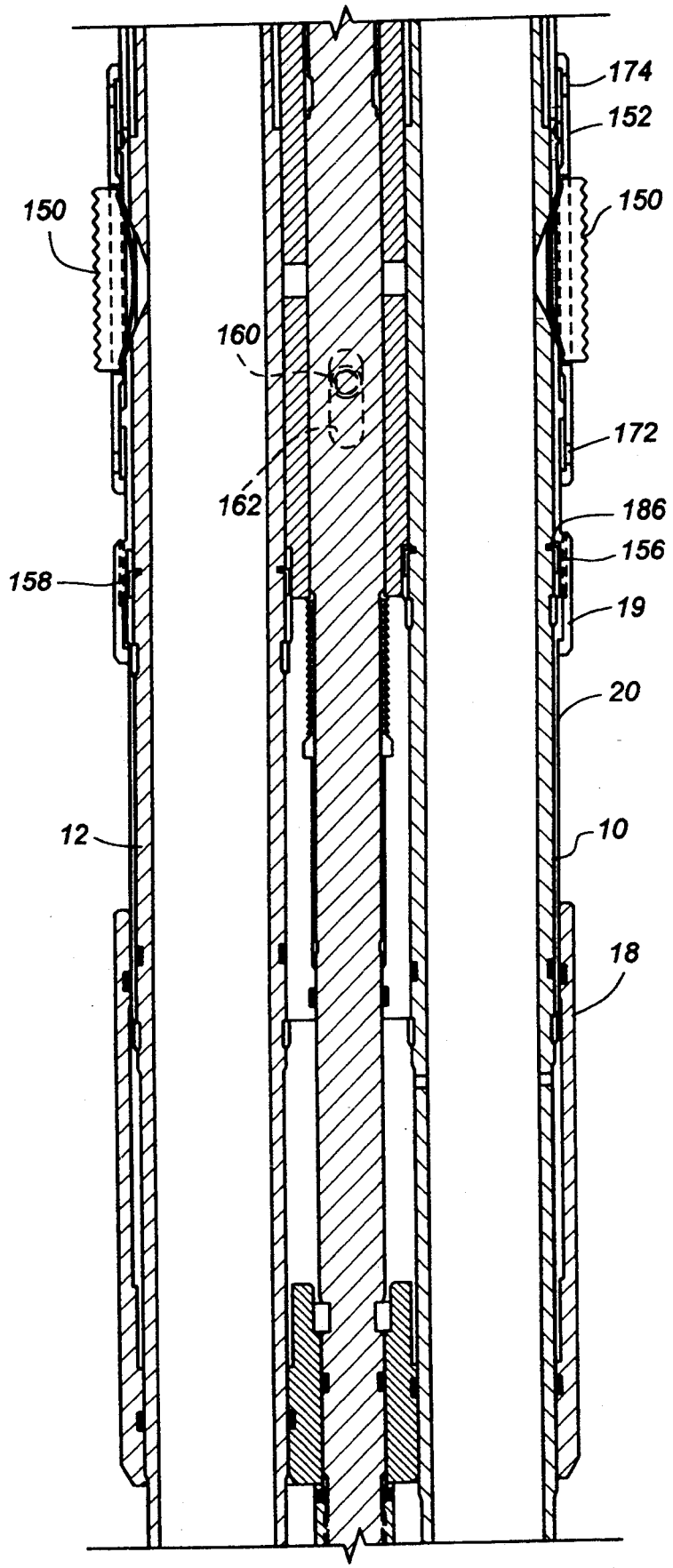
Figure 8C:
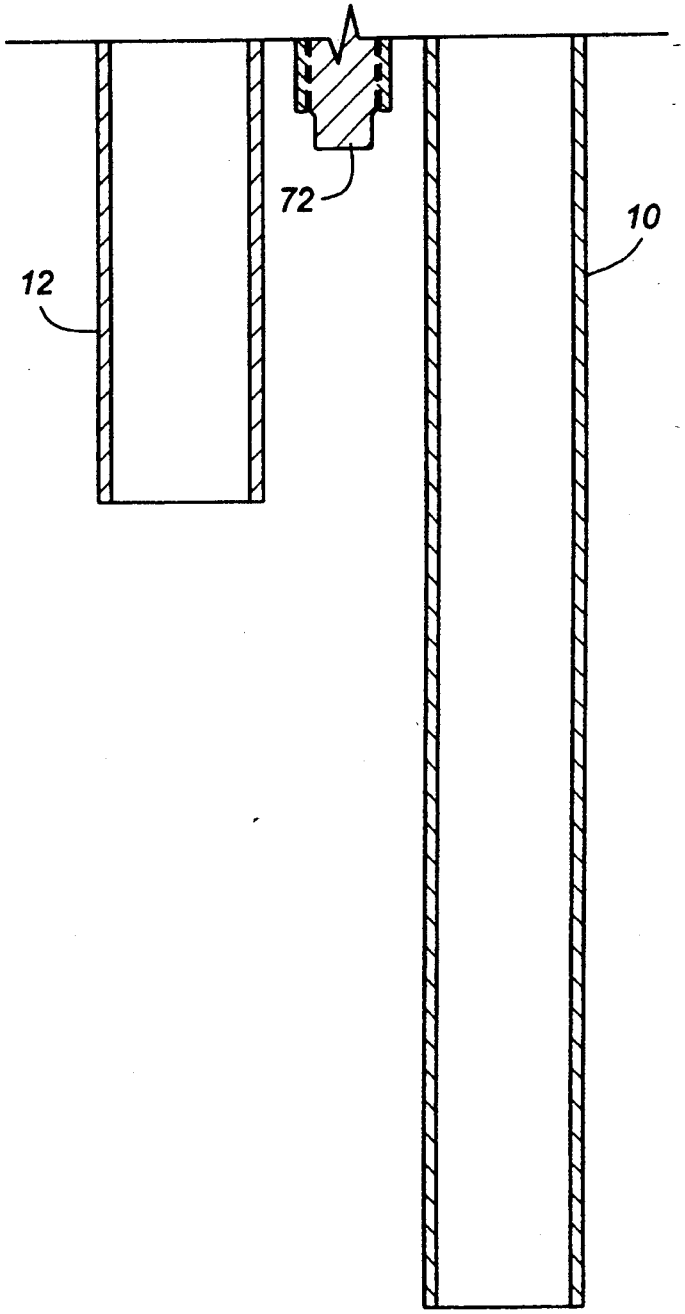
Figure 8D:
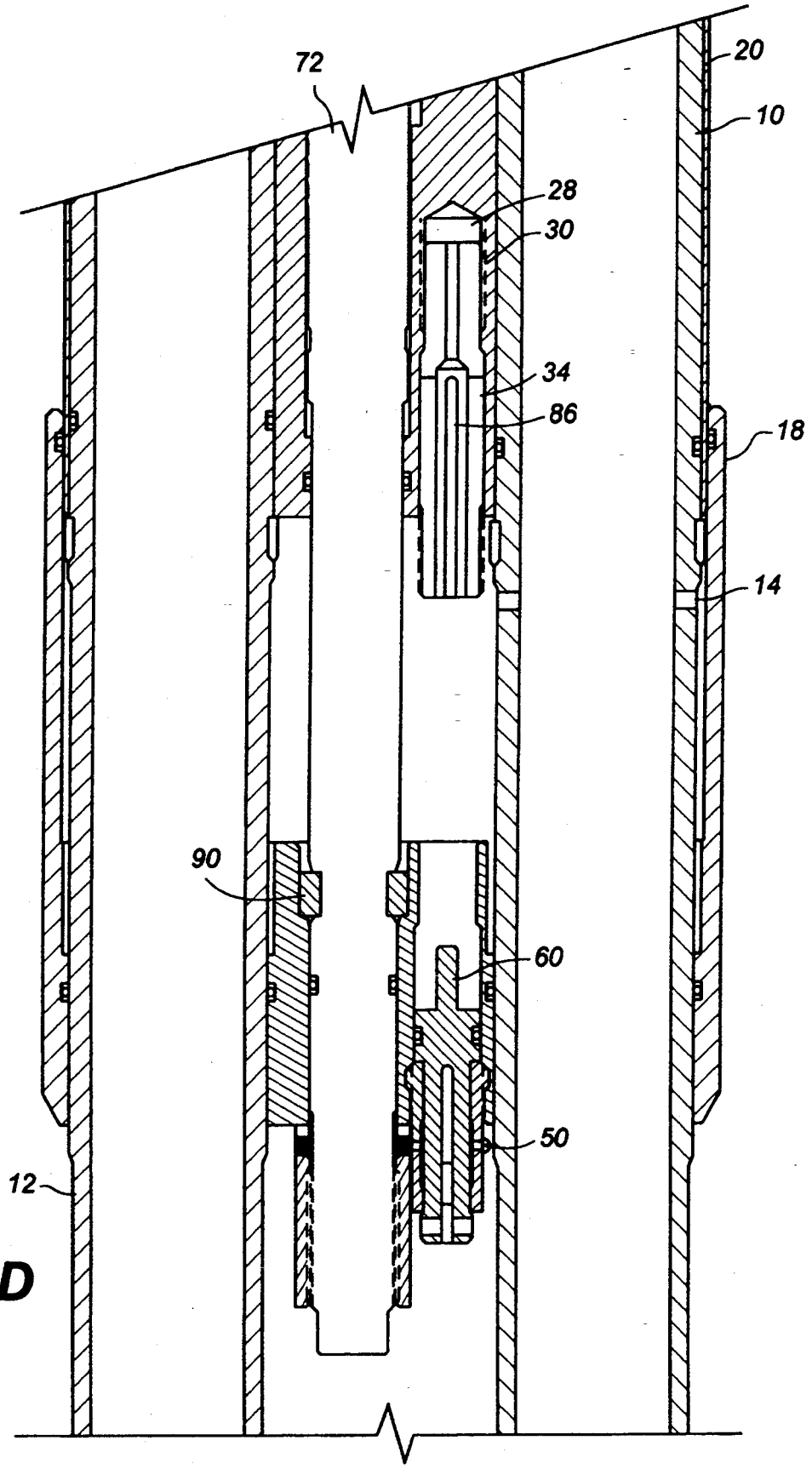
FIG. 8*d* is a different view of FIG. 8*c*, showing the lock mechanism.

FIG. 7 illustrates an alternative embodiment of the lock assembly L. Fluid pressure is applied through ports 190, which drives a piston 192 downwardly. Piston 192 is selectively retained by a shear pin (not shown) to prevent movement before initial pressure builds up. Sealing contact around piston 192 is maintained by O-ring seal 194. As in the embodiment shown in FIG. 2*c*, the hub 196 is threadedly engaged to stud 198 at thread 200. Stud 198 has another thread 202 which engages a locking member 204 at a thread 206. Preferably, locking member 204 is segmented with a built-in stored force to get it into the position shown in the assembly of FIG. 7. In operation, when sufficient pressure is applied into ports 190, piston 192 is displaced downwardly, removing support between the stud 198 and the locking member 204. Eventually, piston 192 bottoms on snap ring 208. At the same time, surface 210 on piston 192 moves away from locking member 204. When that happens, locking member 204 springs radially outwardly and becomes trapped against surface 212. When this occurs, piston 192 becomes substantially immobilized, thereby minimizing wear on O-ring seal 194 should there be fluctuations in pressure after the apparatus A is set in the wellbore. The lock assembly L shown in FIG. 7 also has a transverse bore 214 whose purpose is identical to bore 58 shown in FIG. 2D. As in the embodiment shown in FIG. 2D, the embodiment shown in FIG. 7, when actuated, allows for a release longitudinally between the setting piston 196 and the piston 216 and it is externally accessible for test purposes of seals in the apparatus A.

Those skilled in the art will now appreciate that the various embodiments of the locking mechanism L simplify the test procedure for a multi-bore packer illustrated in FIG. 2*a*–2*c*. Additionally, the reliability of the seals in the locking mechanism is enhanced because the lock assembly L, after being triggered to unlock, has its components retained, preferably stationary but alternatively within a narrow range of motion, so as to prevent unnecessary wear on sealing components in the locking mechanism L. The apparatus A allows for a multi-bore packer with a simple, symmetrical outer seal assembly. While a particular layout of sealing elements 132, 136, and 140 has been depicted, other configurations of a seal assembly, whether in one or more components, are also within the purview of the invention so long as the sealing element is an annular element that circumscribes all the mandrels which pass therethrough. By using a plurality of O-ring-type seals, the apparatus A of the present invention allows setting at substantially lower pressures than in prior designs. This is because the area of applied pressure from ports 14 is significantly larger in this type of design. The pressure migrating into cavities 16 and 70 acts on a far greater area, therefore allowing reduced surface pressure to set the apparatus A, in the order of 2500 lbs or less. The apparatus A offers the further advantage that after setting with a low setting force, additional incremental forces applied from pressure fluctuations from either uphole or downhole, allows for an increase and a locking in, by virtue of the operation of lock rings 180 and 168, of the force on the sealing element or elements to further ensure the reliable function of the apparatus A.

Using a concentric sealing system, as illustrated in FIG. 2, in a multi-bore application dramatically improves the ability to obtain a seal against the casing when compared to prior designs where the seal encircles individually each and every mandrel that passes therethrough. The layout of the components making additional cross-sectional area available for shifting the piston 18, thereby making possible the use of cavity 70, in turn allows for reliable setting of the slips 150 and the sealing elements 132, 136, and 140 with pressures less than 2500 lbs. In some installations, the surface equipment may not be suitable for application of any greater pressures. However, should additional packers be stacked and pressure changes occur, the apparatus A of the present invention allows those higher differential pressures that are applied during operations to exert a greater sealing and locking in force on the sealing elements, thereby ensuring the continuing beneficial operation of the apparatus A in sealing against the casing.

Those skilled in the art will appreciate that while two mandrels 10 and 12 are illustrated, the apparatus A can be deployed with additional mandrels should the application so require and still function as described above.

The foregoing disclosure and description of the invention are illustrative and explanatory thereof, and various changes in the size, shape and materials, as well as in the details of the illustrated construction, may be made without departing from the spirit of the invention.

We claim:

1. A multi-tube packer for sealing against casing, comprising:

a plurality of mandrels;

an actuating piston;

said mandrel extending through said piston, said piston sealingly movable with respect to said mandrels;

a sealing element mounted to said mandrel and operably connected to said actuating piston for movement between a relaxed position for run-in and an extended position for sealing against the casing;

at least one of said mandrels formed having a port to allow flow communication from said mandrels to said piston;

said piston having a face, responsive to fluid pressure from at least one of said mandrels, said face substantially circumscribing said mandrels and further disposed at least in part between or among said mandrels.

2. The packer of claim 1, wherein:

said piston area is sufficient to allow movement of said sealing element into said extended position with a mandrels pressure of less than 2500 psig.

3. The packer of claim 1, further comprising:

compensating means for increasing sealing force on said sealing element, responsive to uphole or downhole pressure fluctuation after said sealing element is placed in said extended position.

4. The packer of claim 3, wherein:

said compensating means is responsive to both uphole and downhole pressure fluctuations to increase sealing force after said sealing element is in said extended position.

5. The packer of claim 4, further comprising:

a sleeve circumscribing said mandrels and movably mounted with respect to said mandrels, said sealing element supported by said sleeve, said sleeve exposed to wellbore pressure when said sealing element is in said extended position;

said compensating means further comprises:

a first lock assembly operable between said sleeve and at least one of said mandrels whereupon actuation of said sealing element into said extended position, said sleeve is able to shift responsive to pressure fluctuations applied thereto to increase an applied sealing force to said sealing element and lock such motion, thereby preventing opposed motion which would tend to reduce applied sealing force.

6. The packer of claim 5, wherein said compensating means further comprises:

a second lock assembly operable on said actuating piston and responsive to pressure build-up in the wellbore from the opposite direction as said first lock assembly, said second lock assembly allowing said piston to move unidirectionally, responsive to pressure fluctuation, to add to and lock in a sealing force on said sealing element.

7. The packer of claim 1, further comprising:

a hub disposed adjacent said piston and supported by at least one of said mandrels;

a lock extending between said hub and said piston, said lock accessible from outside said piston;

said lock further comprising lock-retaining means for allowing temporary fixation of said lock in a locked position where said piston is retained to said hub, said lock-retaining means facilitating testing of the packer without risk of actuation of said sealing element.

8. The packer of claim 7, wherein said lock further comprises:

a lock piston movable between a first position, where said actuating piston is locked to said hub, and a second position, where said actuating piston is free to move with respect to said hub;

said lock-retaining means further comprises:

a capture member which engages said lock piston adjacent its said second position and retains it against substantial return movement back towards its said first position.

9. The packer of claim 8, wherein said lock further comprises:

a collet assembly connected on one end to said hub and having at least one collet selectively engaging said actuating piston when said lock piston is in its said first position;

said capture member further comprises:

a tubular extension from said actuating piston;

at least one shear pin to retain said lock piston to said tubular extension when said lock piston is in its said first position;

said extension formed having a transverse bore therethrough, said bore accepting an object therethrough, whereupon said lock piston is prevented from movement against said shear pin while testing the packer.

10. The packer of claim 9, wherein:

said lock piston has an expanding element which is free to move outwardly upon stroking of said lock piston to its said second position to engage said extension for prevention of substantial return movement toward its said first position.

11. The packer of claim 9, further comprising:

a collar mounted around said lock piston when in its said first position, said collar, upon movement of said lock piston from its said first to second positions, expands to substantially occupy the path of said lock piston, thereby substantially preventing its return movement.

12. The packer of claim 2, further comprising;

a hub mounted sealingly against said mandrels;

said piston sealingly movable with respect to said hub, creating at least one variable-volume cavity therebetween;

whereupon application of pressure through said port and into said cavity, said pressure acts on a face area of said piston within said cavity which extends circumferentially and substantially circumscribes said mandrels as well as an area disposed between or among said mandrels.

13. A multi-tube packer for sealing against casing, comprising:

a plurality of mandrels;

an actuating piston;

said mandrels extending through said piston, said piston sealingly movable with respect to said mandrels;

a sealing element mounted to said mandrels and operably connected to said actuating piston for movement between a relaxed position for run-in and an extended position for sealing against the casing;

at least one of said mandrels formed having a port to allow flow communication from said mandrel to said piston;

said piston having a face, responsive to fluid pressure from at least one of said mandrels, said face substantially circumscribing said mandrels and further disposed at least in part between or among said mandrels;

compensating means for increasing sealing force on said sealing element, responsive to uphole or downhole pressure fluctuation after said sealing element is placed in said extended position;

said compensating means is responsive to both uphole and downhole pressure fluctuations to increase sealing force after said sealing element is in said extended position;

a sleeve circumscribing said mandrels and movably mounted with respect to said mandrels, said sealing element supported by said sleeve, said sleeve exposed to wellbore pressure when said sealing element is in said extended position;

said compensating means further comprises:

a first lock assembly operable between said sleeve and at least one of said mandrels whereupon actuation of said sealing element into said extended position, said sleeve is able to shift responsive to pressure fluctuations applied thereto to increase an applied sealing force to said sealing element and lock such motion, thereby preventing opposed motion would tend to reduce applied sealing force;

said compensating means further comprises:

a second lock assembly operable on said actuating piston and responsive to pressure build-up in the wellbore from the opposite direction as said first lock assembly, said second lock assembly allowing said piston to move unidirectionally, responsive to pressure fluctuation, to add to and lock in a sealing force on said sealing element;

said first lock assembly is operable in response to a rise in downhole pressure with respect to said sealing element in said extended position, and said second lock assembly is responsive to a rise in uphole pressure with respect to said sealing element in said extended position.

14. The packer of claim 13, wherein said first and second lock assemblies each comprise a ratchet mechanism.

15. The packer of claim 14, further comprising:

a rod connected to said piston;

said rod connected to a ring, said sealing element disposed between said sleeve and said ring;

said ring disposed at an opposite end of the packer from said piston, said ratchets disposed at least in part on said rod.

16. The packer of claim 19, further comprising:

a hub disposed adjacent said piston and supported by at least one of said mandrels;

a lock extending between said hub and said piston, said lock accessible from outside said piston;

said lock further comprising lock-retaining means for allowing temporary fixation of said lock in a locked position where said piston is retained to said hub, said lock-retaining means facilitating testing of the packer without risk of actuation of said sealing element.

17. The packer of claim 16, wherein said lock further comprises:

a lock piston movable between a first position, where said actuating piston is locked to said hub, and a second position, where said actuating piston is free to move with respect to said hub;

said lock-retaining means further comprises:

a capture member which engages said lock piston adjacent its said second position and retains it against substantial return movement back towards its said first position.

18. The packer of claim 17, wherein said lock further comprises:

a collet assembly connected on one end to said hub and having at least one collet selectively engaging said actuating piston when said lock piston is in its said first position;

said capture member further comprises:

a tubular extension from said actuating piston;

at least one shear pin to retain said lock piston to said tubular extension when said lock piston is in its said first position;

said extension formed having a transverse bore therethrough, said bore accepting an object therethrough, whereupon said lock piston is prevented from movement against said shear pin while testing the packer.

19. The packer of claim 18, wherein:

said lock piston has an expanding element which is free to move outwardly upon stroking of said lock piston to its said second position to engage said extension for prevention of substantial return movement toward its said first position.

20. The packer of claim 18, further comprising:
a collar mounted around said lock piston when in its said first position, said collar, upon movement of said lock piston from its said first to second positions, expands to substantially occupy the path of said lock piston, thereby substantially preventing its return movement.

21. A multi-mandrels packer for sealing against casing, comprising:
a plurality of mandrels;
an actuating piston;
said mandrels extending through said piston, said piston sealingly movable with respect to said mandrels;
a sealing element mounted to said tubes and operably connected to said actuating piston for movement between a relaxed position for run-in and an extended position for sealing against the casing;
at least one of said mandrels formed having a port to allow flow communication from said tube to said piston;
compensating means for increasing sealing force on said sealing element, responsive to uphole or downhole pressure fluctuation after said sealing element is placed in said extended position.

22. The packer of claim 21, wherein:
said compensating means is responsive to both uphole and downhole pressure fluctuations to increase sealing force after said sealing element is in said extended position.

23. The packer of claim 18, further comprising:
a sleeve circumscribing said tubes and movably mounted with respect to said tubes, said sealing element supported by said sleeve, said sleeve exposed to wellbore pressure when said sealing element is in said extended position;
said compensating means further comprises:
a first lock assembly operable between said sleeve and at least one of said tubes whereupon actuation of said sealing element into said extended position, said sleeve is able to shift responsive to pressure fluctuations applied thereto to increase an applied sealing force to said sealing element and lock such motion, thereby preventing opposed motion which would tend to reduce applied sealing force.

24. A multi-tube packer for sealing against casing, comprising:
a plurality of mandrels;
an actuating piston:
said mandrels extending through said piston, said piston sealingly movable with respect to said mandrels;
a sealing element mounted to said mandrels and operably connected to said actuating piston for movement between a relaxed position for run-in and an extended position for sealing against the casing;
at least one of said mandrels formed having a port to allow flow communication from said mandrel to said piston;
compensating means for increasing sealing force on said sealing element, responsive to uphole or downhole pressure fluctuation after said sealing element is placed in said extended position;
said compensating means is responsive to both uphole and downhole pressure fluctuations to increase sealing force after said sealing element is in said extended position;
a sleeve circumscribing said mandrels and movably mounted with respect to said mandrels, said sealing element supported by said sleeve, said sleeve exposed to wellbore pressure when said sealing element is in said extended position;
said compensating means further comprises:
a first lock assembly operable between said sleeve and at least one of said mandrels whereupon actuation of said sealing element into said extended position, said sleeve is able to shift responsive to pressure fluctuations applied thereto to increase an applied sealing force to said sealing element and lock such motion, thereby preventing opposed motion which would tend to reduce applied sealing force;
said compensating means further comprises:
a second lock assembly operable on said actuating piston and responsive to pressure build-up in the wellbore from the opposite direction as said first lock assembly, said second lock assembly allowing said piston to move unidirectionally, responsive to pressure fluctuation, to add to and lock in sealing force on said sealing element.

25. The packer of claim 24, wherein:
said first lock assembly is operable in response to a rise in downhole pressure with respect to said sealing element in said extended position, and said second lock assembly is responsive to a rise in uphole pressure with respect said sealing element in said extended position.

26. The packer of claim 25, wherein said first and second lock assemblies each comprise a ratchet mechanism.

27. The packer of claim 26, further comprising:
a rod connected to said piston;
said rod connected to a ring, said sealing element disposed between said sleeve and said ring;
said ring disposed at an opposite end of the packer from said piston, said ratchets disposed at least in part on said rod.

28. The packer of claim 27, wherein:
said piston area is sufficient to allow movement of said sealing element into said extended position with a tubing pressure of less than 2500 psig.

29. The packer of claim 27, further comprising:
a hub mounted sealingly against said mandrels;
said piston and said rod sealingly movable with respect to said hub, creating at least one variable-volume cavity as between said hub, on one hand, and said piston and said rod, on the other hand;
said rod extending through said hub and having said piston connected thereto on one side of said hub and said ring connected to said rod on another side of said hub;
whereupon application of pressure through said port and into said cavity, said pressure acts on a face area of said piston within said cavity which extends circumferentially and substantially circumscribes said mandrels as well as substantially circumscribing said rod.

30. A lock assembly for a downhole tool, having a body and a movable member with respect to the body, sealingly mounted with the body, and actuating the tool upon pressure build-up supplied through said body, the improvement comprising:

a longitudinal lock selectively retaining the body to the movable member;

said longitudinal lock further comprising a back-up locking member mounted accessible to rig personnel during make-up of the tool for running downhole; and back-up lock means selectively operable with said back-up locking member to defeat the ability of said longitudinal lock to release said movable member from said body upon application of a force which would have otherwise resulted in such release.

31. The lock assembly of claim 30, wherein:

said longitudinal lock further comprises a lock piston movable from a first position, for locking said base to said movable member, to a second position where said movable member is released from said base;

first means for retaining said locking piston in said first position until a predetermined force is applied through said body;

second means for retaining said locking piston substantially adjacent to its said second position upon overcoming said first means.

32. The lock assembly claim 31, wherein said second means further comprises:

at least one resilient member on said lock piston biased in a first direction when said lock piston is in said first position and moving in a second and opposite direction by the time said lock piston reaches its said second position.

33. The lock assembly claim 32, wherein:

said back-up locking member comprises a tubular member extending from said movable member;

said resilient member retained in said first direction by said tubular member until movement of said lock piston places said resilient member in opposition to a portion of said tubular member, where said resilient member can move in said second direction for engagement thereto.

34. The lock assembly of claim 33, wherein:

said resilient member has a portion thereof extend beyond said tubular member to allow said resilient member to move in said second direction to lock said lock piston to the tubular member when said lock piston comes adjacent to its said second position.

35. The lock assembly of claim 30, wherein said back-up locking member further comprises:

an elongated tube extending from said movable member, formed having a transverse bore therethrough;

said longitudinal lock comprises a piston movable in said tubular member;

said bore positioned adjacent said piston when said piston is in a first position, keeping said base locked to said movable member;

said piston selectively retained in said first position by at least one frangible member;

whereupon insertion of a rigid object through said bore, said piston is immobilized, preventing breakage of said frangible member when said movable member is subjected to a force during a test.

36. The lock assembly of claim 31, wherein said longitudinal lock further comprises:

a lock piston;

said second means comprises a flexible member substantially circumscribing said lock piston, said flexible member storing a force when said lock piston is in a first position retaining the base to the movable member, whereupon movement of said lock piston to a second position releasing the movable member from the base, said flexible member flexes outwardly, obstructing a return path for said lock piston.

* * * * *

UNITED STATES PATENT AND TRADEMARK OFFICE
Certificate

Patent No. 5,425,418 Patented: June 20, 1995

On petition requesting issuance of a certificate for correction of inventorship pursuant to 35 U. S. C. 256, it has been found that the above-identified patent, through error and without deceptive intent, improperly sets forth the inventorship.

Accordingly, it is hereby certified that the correct inventorship of this patent is: Napoleon Arizmendi, Magnolia, Tex.; Jeffrey J. Lembcke, Houston, Tex.; and William D. Henderson, League City, Tex.

Signed and Sealed this Seventeenth Day of March, 1998.

TAMARA L. GRAYSAY
*Supervisory Patent Examiner*
Art Unit 3506